US005177911A

United States Patent [19]

Ruemelin et al.

[11] Patent Number: 5,177,911

[45] Date of Patent: Jan. 12, 1993

[54] ABRASIVE BLAST CABINET

[76] Inventors: Charles R. Ruemelin, 7710 N. Boyd Way, Fox Point, Wis. 53217; Robert J. Ruemelin, 4765 N. Newhall, Whitefish Bay, Wis. 53211

[21] Appl. No.: 792,903

[22] Filed: Nov. 15, 1991

[51] Int. Cl.[5] ..... B24C 9/00; B24B 49/12

[52] U.S. Cl. ..... 51/426; 51/425; 51/273; 51/165.72

[58] Field of Search ..... 51/410, 424, 425, 426, 51/427, 165.72, 268, 269, 272, 319, 320, 321

[56] References Cited

U.S. PATENT DOCUMENTS

| | | | |
|---|---|---|---|
| 2,576,008 | 11/1951 | Gladfelter | 51/426 |
| 3,103,765 | 9/1963 | Nolan | 51/426 |
| 3,300,902 | 1/1967 | Dockery | 51/426 |
| 3,982,605 | 9/1976 | Sneckenberger | 51/439 |
| 4,300,318 | 11/1981 | Brown | 51/425 |
| 4,505,077 | 3/1985 | Sheesley et al. | 51/415 |
| 4,579,570 | 4/1986 | Klass | 55/305 |
| 4,928,440 | 5/1990 | Hughes | 51/427 |
| 5,042,335 | 8/1991 | Ciboldi | 51/165.72 |

*Primary Examiner*—Bruce M. Kisliuk
*Assistant Examiner*—Bo Bounkong
*Attorney, Agent, or Firm*—Michael, Best & Friedrich

[57] ABSTRACT

The abrasive blast cabinet includes a housing defining a blast chamber, a blast nozzle disposed in the blast chamber and connected to a source of an abrasive blast media for directing a flow of the blast media carried in a stream of air under pressure against a surface of an article to be cleaned, an elongated tubular member supported by the housing front wall and having an inner end portion located inside the blast chamber in the vicinity of a work place for the article and an outer end portion including a viewing port through which an operator located outside the blast chamber can direct his or her line of sight through the interior of the tubular member and observe the article in the work place, a conduit or stack open to the atmosphere and connected in fluid communication with the interior of the tubular member, and ventilation means, such as an exhaust fan, for removing from the blast chamber blast media dispersed therein and for drawing ambient air through the stack and the tubular member and discharging same from the outlet of the tubular member in a direction toward a viewing zone in the vicinity of the article and at a velocity and volume sufficient to purge blast media dispersed inside the blast cabinet away from the article being cleaned so that the operator can view the article and the cleaning action.

29 Claims, 3 Drawing Sheets

ABRASIVE BLAST CABINET

BACKGROUND OF THE INVENTION

I. Field of the Invention

This invention relates to apparatus for cleaning or finishing the surface of articles by directing a more pressurized flow of a cleaning media against the article surface and, in one aspect, to abrasive blast cabinets capable of using a fine powder abrasive blast media for that purpose.

II. Description of the Prior Art

Abrasive blast cabinets typically include a blast compartment or chamber in which the article or articles to be cleaned or polished by an abrasive blasting material are placed. The operator usually reaches through arm holes protected by rubber gloves and, observing through a front window in the blast chamber, either picks up an article to be cleaned and moves it under a stationary blast nozzle or picks up a portable blast nozzle and moves it about to direct a high velocity jet stream of the abrasive material over the surfaces of the article.

Abrasive blast cabinets typically are either a suction or pressure type. In suction-type blast cabinets, a stream of pressurized gas flows through in an air jet in a blast gun and creates a vacuum condition which causes the blast media to be aspirated from a source and mixed with the air stream. A high velocity, abrasive media-containing air stream is discharged from the nozzle. In the pressure-type blast cabinet, a flow of compressed air passing through or in communication with a blast media in a storage tank or the like picks up the media and the resulting abrasive media-containing air stream is directed to the blast nozzle. Examples of prior construction for abrasive blast cabinets are disclosed in U.S. Sheesley et al. Pat. No. 4,505,077 and U.S. Klaas Pat. No. 4,579,570.

The blast media typically used with either type blast cabinet is a relatively hard particulate material, such as chilled iron grit or aluminum oxide, which normally experiences a limited break down during use and is recycled for use after removing contaminants.

Fine powder abrasive materials, such as sodium bicarbonate-based materials, are preferred for some applications because they are less harsh to the surface being cleaned, are nonhazardous to persons operating or working in the vicinity of blast cabinets and the disposal of the spent media is greatly simplified. Dry forms of this type of material generally cannot be used as a blast media in conventional blast cabinets because the material is friable and breaks down into dust-like particles which are dispersed throughout the blast cabinet and produce a dense, fog-like condition. This condition cannot be eliminated or adequately reduced by conventional blast cabinet ventilation technology. Consequently, the operator most often is unable to observe the article being cleaned. This is particularly true for operations using higher velocity jet streams.

A similar problem can exist for other cleaning operations employing a finely atomized liquid cleaning media or other cleaning media which tends to disperse in a manner to obscure visibility in the area surrounding the article being cleaned.

SUMMARY OF THE INVENTION

An object of the invention is to provide an apparatus for cleaning or finishing surfaces of articles located inside a housing with a pressurized flow of a cleaning media including an observation arrangement which facilitates observation of the portion of the article being cleaned or finished even though used or spent cleaning media is dispersed throughout the interior of the housing.

Another object of the invention is to provide an abrasive blast cabinet which is capable of employing dry, powder abrasive materials as a blast media and yet the operator can view an article being cleaned.

A further object of the invention is to provide such an abrasive blast cabinet including simple, inexpensive means for maintaining a portion of the blast chamber in the vicinity where an article is being cleaned clear enough of dispersed abrasive media for the operator to view at least the portion of the article being cleaned.

A still further object of the invention is to provide an abrasive blast cabinet including means described in the immediately preceding paragraph and yet not requiring major modifications or the addition of equipment including moving parts to existing blast cabinet designs.

Other objects, aspects and advantages of the invention will become apparent to those skilled in the art upon reviewing the following detailed description, the drawings and the appended claims.

The invention provides an apparatus for cleaning surfaces of articles with a pressurized flow of a cleaning media including a housing defining a cleaning chamber, cleaning means in the chamber for directing a pressurized flow of the cleaning media against the surface of an article to be cleaned, observation means for observing the article during cleaning including a viewing portion situated in the chamber such that there is viewing zone between it and the article being cleaned, and gas delivery means for directing a flow of gas into the viewing zone to purge away a sufficient amount of cleaning media dispersed in the viewing zone to facilitate observation of at least the portion of the article being cleaned.

In the preferred embodiment, the invention provides an abrasive blast cabinet including a housing defining a blast chamber, a blast nozzle in the blast chamber and connected to a source of an abrasive blast media for directing a flow of the blast media carried in a pressurized stream of gas against the surface of an article to be cleaned, window means for observing the article during cleaning including an elongated tubular member having an inner end portion located inside the blast chamber and having an inner viewing port situated so that there is a viewing zone between the inner viewing port and the article being cleaned. The tubular member also has an outer end portion including an outer viewing port through which an operator located outside the blast chamber can direct his or her line of sight through the interior of the tubular member and observe the article being cleaned. Gas delivery means directs a flow of gas into the viewing zone to purge away a sufficient amount of the blast media from the viewing zone to facilitate observation of at least that portion of the article being cleaned.

DESCRIPTION OF THE PREFERRED EMBODIMENTS

The apparatus provided by the invention can be adapted for a wide variety of applications in which an article is cleaned inside a housing or other enclosure by directing a pressurized gas stream containing a dry cleaning media, a liquid cleaning media or a mixture of a dry cleaning media and a liquid, such as water, against a surface of the article and the spent media and/or fine droplets of liquid in mist form are dispersed in the interior of the housing in a manner which can obscure observation of the article being cleaned. It is particularly adaptable for blast cabinets and will be described in connection with that application.

Blast cabinets provided by the invention can be either the suction-type or the pressure-type and can employ a variety of abrasive blast media, including conventional hard grit blast media. The invention is particularly useful with pressure type cabinets employing powder, friable materials as the blast media, either in dry form or mixed with a liquid, such as water. Sodium bicarbonate-based blast media, such as ARMEX blast media marketed by Church & Dwight, Inc., is preferred because such materials are non-toxic and ecologically safe, do not produce an explosive dust and can scour some surfaces to a smooth finish.

Blast cabinets provided by the invention can be used for a wide variety of surface treatments, either flexible or rigid substrates, metallic or non-metallic substrates and flat or contoured surfaces. For example, blast cabinets of the invention can be used to remove grease, dirt, surface rust, aluminum corrosion, and various coatings (e.g., paints, lacquers, etc.) down to a bare substrate or one layer at a time and other surface treatments. As used herein, the terms "clean", "cleaned" and "cleaning" means all of such uses and other applications where contacting the surfaces of an article with a high velocity flow of a blast media or other liquid or cleaning media is or may be an appropriate treatment.

Figure 1:
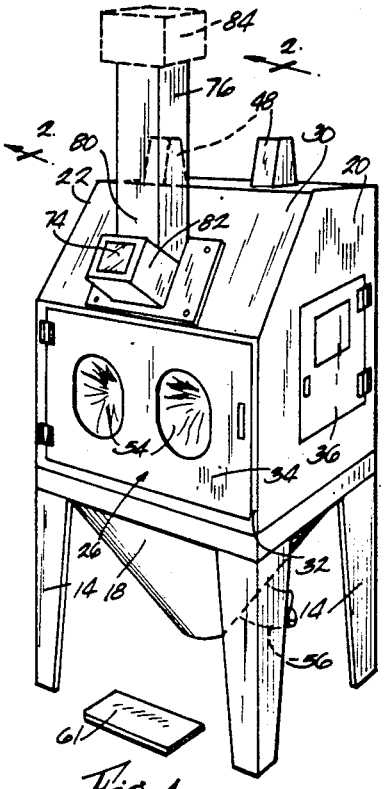
FIG. 1 is a perspective view of a blast cabinet including a viewing window in accordance with the invention.
Figure 2:
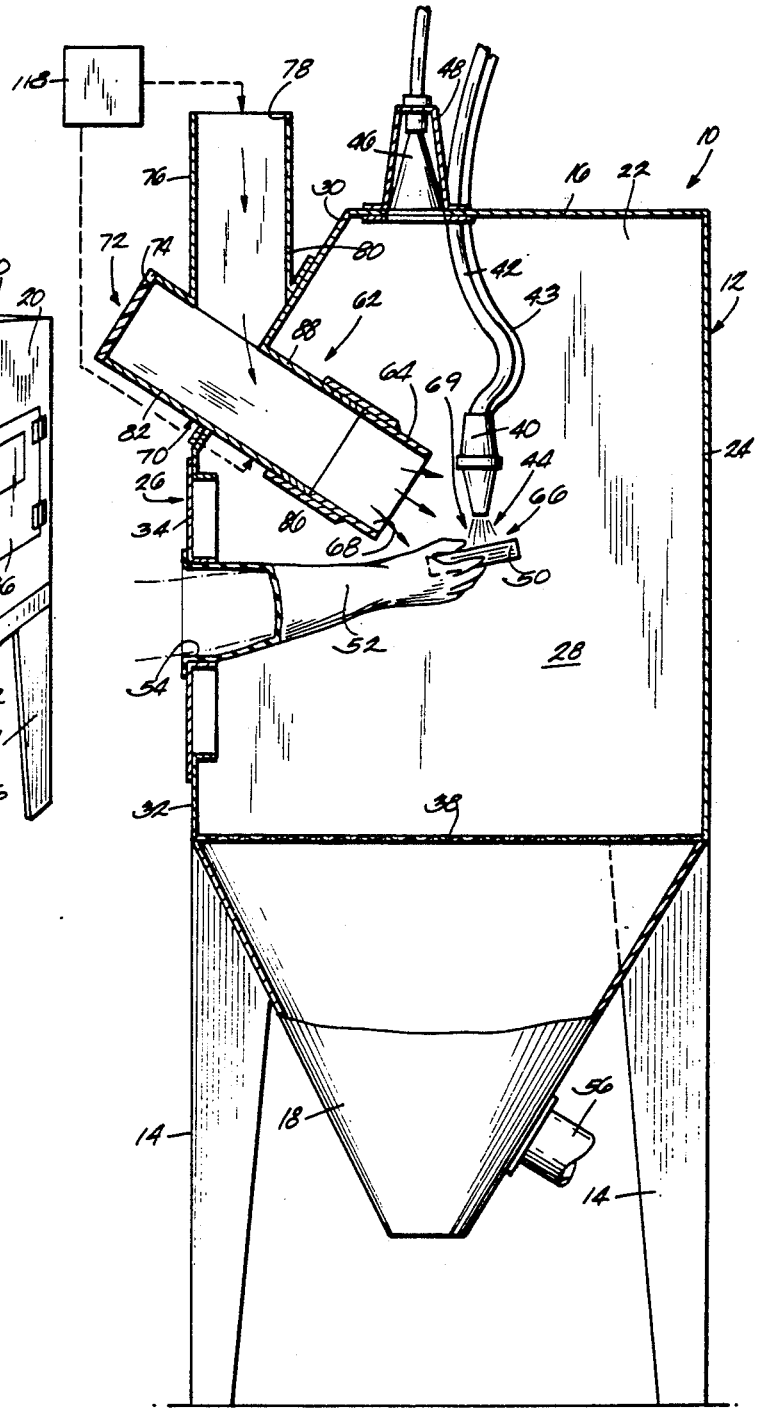
FIG. 2 is a fragmentary, enlarged, sectional view of the blast cabinet taken generally along line 2—2 in FIG. 1.

FIGS. 1 and 2 illustrate an abrasive blast cabinet 10 of the invention which includes a housing 12 supported on legs 14 and having a top wall 16, an inverted pyramid-shaped bottom wall 18, opposed side walls 20 and 22, a back wall 24 and a front wall 26, all of which cooperate to define a blast compartment or chamber 28. The front wall 26 has an inclined upper portion 30 and a vertical lower portion 32 including a hinged access door 34. In the specific construction illustrated, the blast cabinet 10 also includes a hinged side access door 36 in the side wall 20. The access doors 34 and 36 can be opened for access to the blast chamber 28 for inserting and removing articles to be cleaned and both are sealingly closed during operation of the blast cabinet 10.

Disposed in the lower portion of the blast chamber 28 is a perforated platform or floor 38 for temporarily supporting articles to be cleaned and preventing them from being dropped into the hopper formed by the bottom wall 18. It also can be used to support fixtures for holding parts to be blasted with a mobile nozzle. A pressure-type blast nozzle 40 is suspended from the top wall 16. As explained in more detail below, a pressurized stream of air containing a blast media is delivered to the blast nozzle 40 via a conduit or hose 42 and, when a wet blast media is desired, water or another suitable liquid is delivered to the blast nozzle 40 via a conduit to hose 43. A high velocity, pressurized jet stream 44 of air containing dry blast media or containing a mixture of blast media and water is discharged from the blast nozzle 40.

Figure 3:
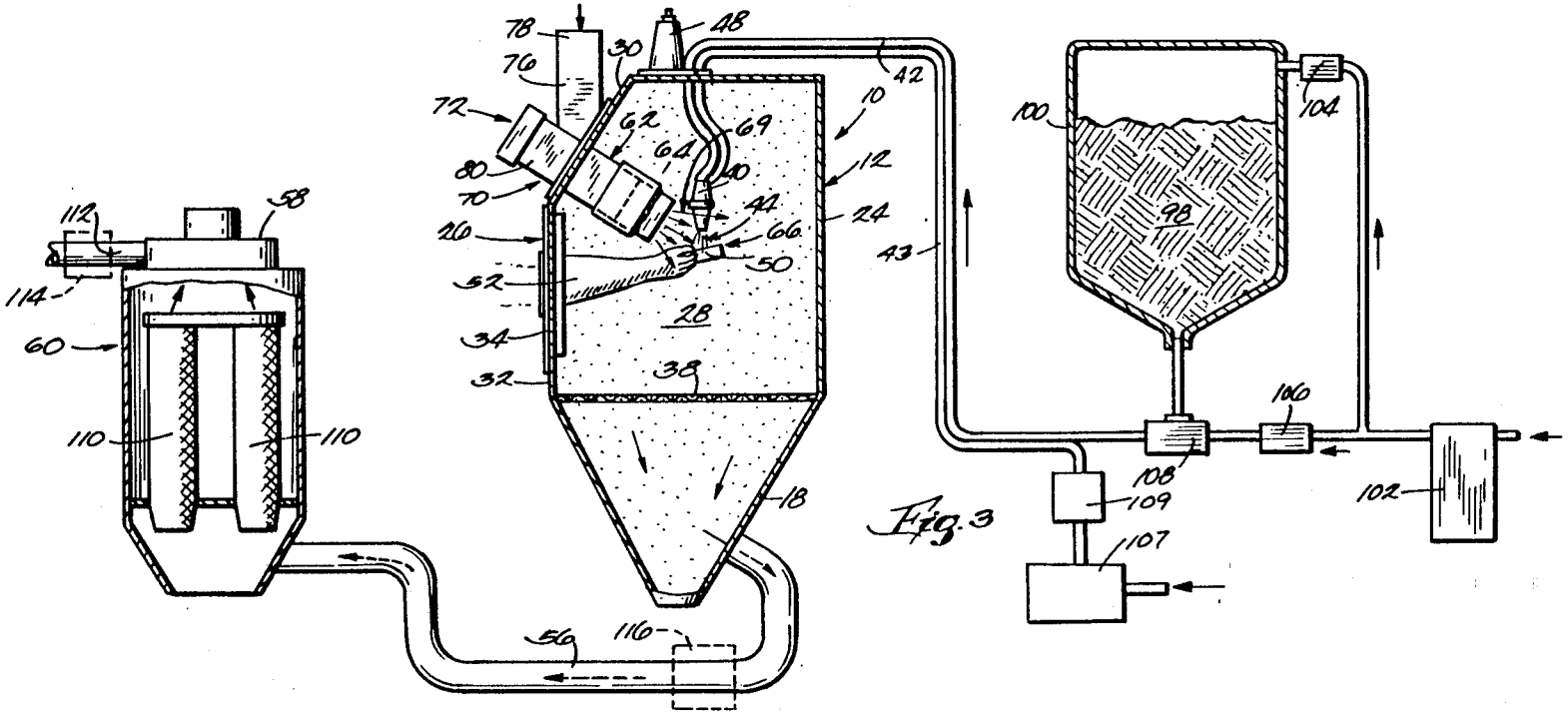
FIG. 3 is a diagrammatic representation of an abrasive blast system including the blast cabinet illustrated in FIGS. 1-2.

The interior of the blast chamber 28 is illuminated by a plurality of flood lights 46 which are installed in support brackets 48 mounted on the top wall 16. An article 50 to be cleaned is held in the jet stream 44 by an operator with a pair of flexible, protective gloves 52 (one shown in FIG. 2) extending from arm holes 54 in the front access door 34. As best shown in FIGS. 2 and 3, used or spent blast media dispersed in the blast chamber 28 is withdrawn therefrom by a ventilation system including an exhaust conduit 56 connected to the bottom of the housing 12 and a suction or exhaust fan 58 mounted on a filter assembly 60.

Located at the front of the blast cabinet 10 is a foot pedal control 61 of conventional design which an operator can depress to control the flow of blast media-containing air to the blast nozzle 40.

The construction described up to this point is for the most part, conventional for abrasive blast cabinets employing hard abrasive media such as chilled iron grit or aluminum oxide grit. If a dry, powder abrasive material, such as a sodium bicarbonate-based blast media, is used at a pressure higher than about 30 psi, the interior of the blast chamber 28 becomes completely filled with dust-like spent blast media, making it impossible for an operator to observe an article being cleaned. If a pressurized stream of air containing a mixture of blast media and water is used as the blast media, the interior of the blast chamber 28 becomes filled with fine droplets of water in the form of a mist which obscures an operator's observation of the article being cleaned.

In accordance with the invention, the inability to see an article being cleaned is eliminated, or at least minimized, by providing gas delivery means for directing a flow of gas into a viewing zone in the vicinity of the article being cleaned and purging away a sufficient amount of the spent blast media or mist to facilitate observation of at least that portion of the article being cleaned. In the embodiment illustrated in FIGS. 1-5, provided for this purpose is a window means designed to both focus the operator's line of sight on the article being cleaned and concentrate a flow of air toward the viewing zone to purge away spent blast media or mist dispersed inside the blast chamber 28 away from the viewing zone.

More particularly, such window means includes an elongated tubular member 62 supported from the inclined upper portion 30 of the front wall 26. The tubular member 62 has an inner end portion 64 located inside the blast chamber 28 in the vicinity of a work place 66 where an article 50 to be cleaned is held in the jet stream 44 exiting from the blast nozzle 40. The inner end portion 64 has an outlet 68 which is open to the blast chamber 28 and serves as an inner viewing port located adjacent a viewing zone 69 in the vicinity of the article 50. The tubular member 62 also has an outer end portion 70 including an outer viewing port 72 through which an operator standing outside blast cabinet 10 can direct his or her line of sight through the interior of the tubular member 62 and observe the article 50 in the work place 66. The outer viewing port 72 preferably includes a transparent window 74 closing the interior of the tubular member 62 so that blast media and noise generated inside the blast chamber 28 by the blasting operation is not expelled from the tubular member 62.

The gas delivery means includes a supply for delivering a flow of air or other gas into the hollow interior of the tubular member 62 for discharge from the outlet 68 in a direction toward the viewing zone 69 and at a velocity and volume sufficient to purge spent blast media, normally dispersed in the viewing zone 69, away from at least that portion of the article being cleaned.

In the specific construction illustrated in FIGS. 1–5, there is provided an air supply means including a generally vertical conduit means or stack 76 having an upper end 78 open to the atmosphere and a lower end 80 mounted in fluid communication with the interior of the tubular member 62 at a location inwardly from the window 74. The interior of the stack 76 and the tubular member 62 are dimensioned and the exhaust fan 58 is operated in a manner to suck or draw a stream of ambient air through the stack 76 and the tubular member 62 at a sufficient velocity and volume to blow or purge a sufficient amount the spent blast media or mist away from the article 50 to facilitate observation of at least that part of the article 50 being cleaned. The opening in the upper end 78 of the stack 76 preferably is the only air inlet into the blast chamber 28. As a general guide, an air flow in the order of 2000 cfm through a tubular member having a cross sectional area of about 30 square inches is sufficient for blast nozzle pressures to up to about 90 psi.

As used herein, the terms "purge" and "purging" means deflecting, diverting, or otherwise physically displacing a substantial amount, but not necessarily all, of the spent blast or other cleaning media, normally dispersed in the viewing zone in the vicinity of the article being cleaned, away from the viewing zone so that the article can be observed.

In the particular construction illustrated, the outer end portion 70 of the tubular member 62 includes an extension 82 which extends outwardly from the inclined upper portion 30 of the front wall 26 to facilitate mounting of the stack 76 on the tubular member 62 and the window 74 covers the terminal end of the extension 82. However, it should be appreciated that other inlet arrangements can be used, including openings in the sides, top and/or bottom of the extension or one or more stacks open to the atmosphere but connected to the tubular member 62 inside the blast chamber 28. Also, the air flow does not necessarily have to be delivered through the interior of the tubular member 62. Instead, it can be delivered through conduits located adjacent the outer walls of the tubular member or at other locations in the blast chamber 28, so long as the incoming air is directed toward the viewing zone.

The high velocity flow of air through the tubular member 62 can generate considerable noise, as does the blasting operation inside the chamber 28. Use of a vertical stack as illustrated moves the source of the noise away from an operator. As illustrated diagrammatically by dashed lines in FIG. 1, the noise problem can be minimized by installing in the inlet portion of the stack 76 a conventional silencer 84 capable of attenuating the sound normally generated by the flow of air through the stack 76 and the tubular member 62 and by the blasting operation inside the blast chamber 28.

Figure 4:
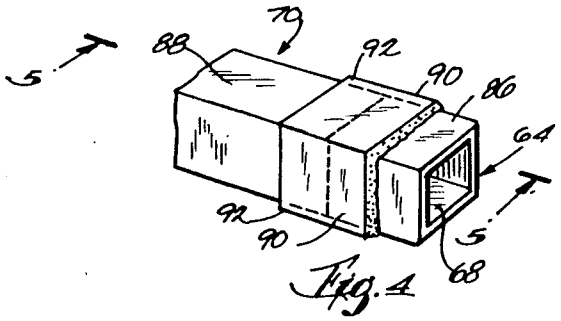
FIG. 4 is a fragmentary, perspective view of the inner end portion of the tubular member.
Figure 5:
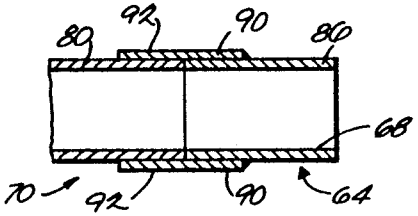
FIG. 5 is a sectional view taken generally along line 5—5 in FIG. 4.

The tubular member 62 preferably is arranged so that the distance between the outlet 68 and the work place 66 can be adjusted. Various suitable arrangements can be used, including a telescopic arrangement of two or more parts, a bellows arrangement and the like. In the specific construction illustrated, the tubular member 62 is a two part assembly. As best shown in FIGS. 4 and 5, the first part 86 is the inner end portion 64 and the second part of 88 is the outer end portion 70 of the tubular member 62. The first part 86 includes a plurality of a relatively rigid, longitudinally extending extensions 90, each affixed at one end on the outer surface of each wall of the first part 86. The free ends 92 of the extensions 90 fit snugly over and slidably engage the outer surfaces of the second part 88 in a friction fit when the first part 86 is moved into abutting relationship with the second part 88 as best shown in FIGS. 4 and 5. A number of first parts 86 of different length are provided. For example, one 4 inches long, another 5 inches long, another 6 inches long, etc. With this arrangement, the distance between the outlet 68 of the tubular member 62 and the work place 66 can be adjusted to provide optimal cleaning and/or viewing range by using a first part 86 of the appropriate length. An adjustment can be made by opening either the front access door 34 or the side access door 36, removing the first part 86 installed and substituting an appropriate first part 86.

While in the specific construction illustrated the stack 76 and the tubular member 62 both have a rectangular cross section, either or both can have a circular cross section or a variety of other cross sectional shapes and they do not necessarily have to have the same inside cross sectional area. Also, the blast nozzle 40 and the tubular member 62 do not have to fixedly mounted as illustrated. For example, the tubular member 62 can be mounted on the front wall 26 so it can be moved up and down and/or sideways to increase the viewing area inside the blast chamber 28 and the blast nozzle 40 can be a mobile type like in some conventional constructions.

FIG. 3 diagrammatically illustrates a blasting system employing a blast cabinet of the invention and a supply system for delivering a powder sodium bicarbonate-based blast media to the blast cabinet, such as an Accustrip supply system marketed by Schmidt Manufacturing, Inc., Houston, Texas. The blast nozzle 40 and the remainder of the supply system are arranged to deliver either a pressurized stream of air containing dry blast material or a pressurized stream of air containing a mixture of blast media and water.

The Accustrip supply system includes a storage tank 100 for the blast media 98. Pressurized air from a suitable compressor (not shown) flows through a conventional moisture separator 102 to remove moisture therefrom. One portion of the compressed air from the moisture separator 102 is routed to the storage tank 100 via a pressure regulator 104 for adjusting the pressure maintained on the blast media 98 in the storage tank 100. The other portion of the compressed air from the moisture separator 102 is routed to the blast nozzle 40 via a pressure regulator 106 for adjusting the blast pressure and a mixing valve 108 for adjusting the amount of blast media delivered to the blast nozzle 40. The pressure regulators 104 and 106 are adjusted to maintain a predetermined differential pressure between pressure applied on the blast media and the blast pressure.

The Accustrip supply system also includes a pump 107 connected to a water supply (not shown) and a valve 109 for controlling the flow of water to the blast nozzle 40 via the hose 43.

The blast nozzle 40 in the Accustrip supply system has a long venturi nozzle through which either a stream of air containing dry blast media is discharged when the pump 107 is not operating or a stream of air containing a mixture of blast media and water is discharged when the pump 107 is delivering water through the hose 43. In the latter case, water is introduced into the blast media-containing stream delivered through the hose 42 immediately upstream of the venturi nozzle.

The filter assembly 60 in the ventilation system for withdrawing spent blast media from the blast chamber 28 includes one or more suitable filter bags 110 and only the suction side of the exhaust fan 58 communicates with the interior of the filter assembly 60. When the exhaust fan 58 is operating, air flows (as indicated by the arrows) through the stack 76 and the tubular member 62, outwardly into the blast chamber 28 into the vicinity of the work place 66, circulates through the blast chamber 28 and exits from the blast chamber 28 through the bottom of the housing. The exhaust fan 58 draws blast media-laden air from the blast chamber 28 through the exhaust conduit 56, upwardly through the interior of the filter bags 110 and exhausts cleaned air to the atmosphere through an outlet 112 in the fan chamber. If desired, a conventional silencer 114 can be installed in the fan chamber outlet 112 as illustrated by dashed lines in FIG. 3 to reduce noise generated in the ventilation system.

The spent blast media (containing materials cleaned from the article) collecting in the filter assembly 60 is periodically removed for disposal. In many cases, the spent media can be disposed of by sanitary land fill. In cases where the material removed during cleaning requires special handling, a sufficient amount of water can be added to the spent media to solubilize the sodium bicarbonate. The undissolved material, which typically represents about 1% of the spent media and includes such things as paint chips, grease, oil and the like, can be separated by filtering and disposed of in a hazardous land fill. The remainder is dissolved sodium bicarbonate and water and, because of the non-toxic nature of sodium bicarbonate, often can be sewered with waste treatment plant approval.

When the blast media is used in dry form, some will not break down into smaller particles and can be recycled for re-use. Larger, reusable particles can be recovered by employing a conventional particle classifying means, such as a cyclone classifier 116, in the exhaust conduit 56 upstream of the filter assembly 60 as illustrated by dashed lines in FIG. 3 for separating larger particles from smaller broken down particles.

To operate the blast system illustrated, an operator first starts the air compressor and the exhaust fan 58 and switches on the lights 46. The operator, while looking through the window 74, picks up an article to be cleaned with the gloves 52, depresses the foot petal 61 to start blasting and moves the article in the jet stream 44 until the desired cleaning has been completed. After that the operator releases the foot petal 61 and opens either the front access door 34 or the side access door 36 to remove the cleaned article.

Instead of relying on ambient air entering through the inlet of the stack 76 as the sole source of purging air, pressurized air or another suitable gas supplied by a compressor 118, a fan or the like can be introduced directly into the tubular member 62 and/or into the stack 76 as shown by dashed lines in FIG. 2. If compressed air or gas can be supplied at a velocity and volume sufficient to purge the dispersed media away from the viewing zone, the stack 76 can be eliminated and the compressed air introduced into the tubular member 62 at a location inwardly from the window 74. This approach generally is less preferred because it requires additional equipment and higher operating costs than the simple construction illustrated in FIGS. 1-2.

Figure 6:
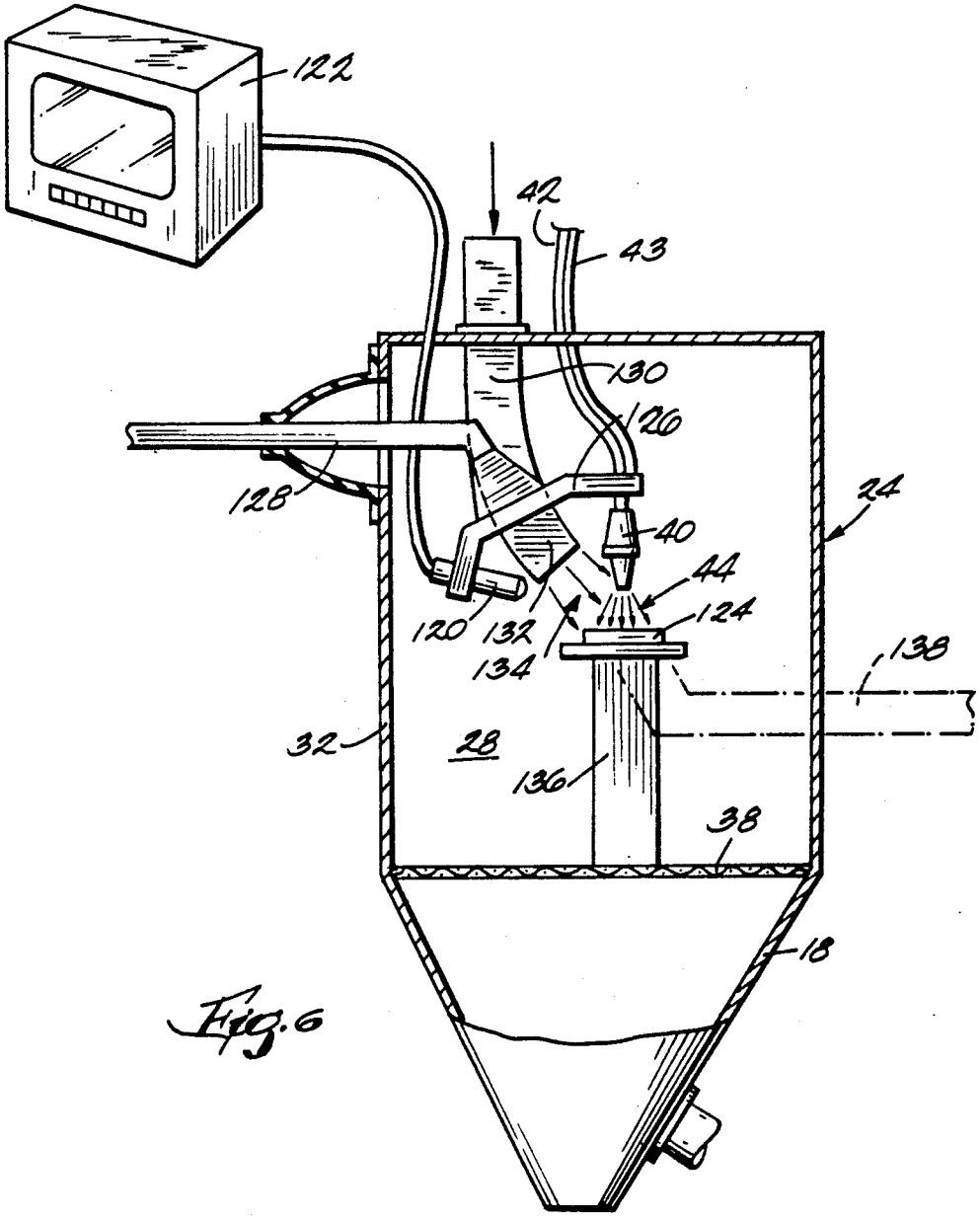
FIG. 6 is a diagrammatic representation of an alternate embodiment employing an automated system including a remote monitor for observing cleaning.

FIG. 6 diagrammatically illustrates an automatic system for cleaning and observing an article being cleaned. The automated system includes a conventional fiberscope or similar fiberoptic image and illumination system including a lens assembly 120 operably connected to a remote visual monitor 122 for displaying the image of an article 124 being cleaned. The lens assembly 120 is mounted on a support bracket 126 carried on a movable member, such as a robotic arm 128, extending into the blast chamber 28. The blast nozzle 40 and a flexible hose 130 for introducing a purge gas into the blast chamber 28 also are mounted on the support bracket 126 to form a unit. The hose 130 serves the same function as the tubular member 62 described above with respect to the purge gas. The lens assembly 120, blast nozzle 40 and the outlet 132 of the hose 130 are located relative to each other so that air or another purge gas introduced through the hose 130 purge spent blast media and/or water mist away from the viewing zone 134 as described above.

In the embodiment illustrated by solid lines in FIG. 6., the article 124 is supported on a stationary platform 136 and the robotic arm 128 is manipulated, by an operator via a suitable control (not shown) or by a computer program, for movement of the lens assembly/blast nozzle/hose unit relative to the article 124 to perform the described cleaning.

Alternatively, the support bracket 126 can be stationary and the article 124 carried by a movable member, such as a robotic arm 138, as illustrated by dashed lines in FIG. 6. With such an arrangement, the article 124 can be manipulated in the jet stream 44 from the stationary blast nozzle 40 to obtain the desired cleaning. Also, both the support bracket 126 and the article 124 can be carried by a robotic arm so that, if desired, both the article 124 and the lens assembly/blast nozzle/hose unit can be manipulated for cleaning.

Instead of being mounted on a support bracket as illustrated, the lens assembly 120 can be supported on the outlet portion of the purge gas hose 130, either inside or outside, and the cable therefor extend along the outside or inside of the purge gas hose 130. In either case, the lens assembly 120 and the cable therefor are located so as not to obstruct or adversely interfere with the flow of gas through or exiting from the purge gas hose 130.

From the foregoing description, one skilled in the art can easily ascertain the essential characteristics of the invention and, without departing from the spirit and scope thereof, make various changes and modifications to adapt it to its various usages.

We claim:

1. A blast cabinet for cleaning surfaces of articles with an abrasive blast media comprising a housing defining a blast chamber with an interior;

a blast nozzle disposed in said blast chamber and connected to a source of an abrasive blast media for directing a flow of the blast media carried in a stream of gas under pressure against a surface of an article to be cleaned located inside said blast chamber whereby spent blast media normally is dispersed throughout said blast chamber in a manner so as to obscure visual observation of a portion of the article being cleaned from outside said blast chamber;

window means for observing the article during cleaning including an elongated tubular member having an interior an inner end portion extending into the interior of said blast chamber and an inner viewing port situated in the vicinity of but spaced from the article to be cleaned so that there is a viewing zone between said inner viewing port and the article to be cleaned, said tubular member further having an outer end portion including an outer viewing port through which an operator located outside said blast chamber can direct his or her line of sight through the interior of said tubular member and observe the article being cleaned through said inner viewing port; and gas delivery means for directing a flow of gas into said viewing zone to provide a purging action for purging away a sufficient amount of spent blast media dispersed in said viewing zone to facilitate observation through said outer viewing port of at least the portion of the article being cleaned.

2. A blast cabinet according to claim 1 wherein the inner end portion of said tubular member is open to said blast chamber; and said gas delivery means includes an air supply means connected in fluid communication with the interior of said tubular member for delivering a flow of air through the interior of said tubular member at a velocity and volume required to produce said purging action.

3. A blast cabinet according to claim 2 wherein said air supply means includes conduit means open to the atmosphere and connected in fluid communication with the interior of said tubular member; and ventilation means for removing spent blast media from said blast chamber and for drawing ambient air through said conduit means and through said tubular member at a velocity and volume required to produce said purging action.

4. A blast cabinet according to claim 2 wherein said air supply means includes means connected in fluid communication with said conduit means for supplying through said tubular member a stream of pressurized air at a velocity and volume required to produce said purging action.

5. A blast cabinet according to claim 3 wherein said housing includes a front wall;

the outer end portion of said tubular member includes an extension extending outwardly beyond said front wall; and said conduit means is connected in fluid communication with the interior of said extension.

6. A blast cabinet according to claim 5 including a silencer in said conduit means for attenuating noise normally created by the flow of air through said conduit means and said tubular member and generated inside said blast chamber by the blasting operation.

7. A blast cabinet according to claim 5 wherein said conduit means is a generally vertical stack extending upwardly from said extension.

8. A blast cabinet according to claim 5 including a transparent window closing the interior of said extension at a location outwardly from the junction between said conduit means and said extension and cooperating with said extension to provide said outer viewing port.

9. A blast cabinet according to claim 2 wherein said tubular member includes adjustment means for adjusting the distance between said inner viewing port and the article being cleaned.

10. A blast cabinet according to claim 9 wherein said adjustment means comprises said tubular member having a plurality of first parts including said inner end portion and said inner viewing port, each having a different length, and a second part including said outer end portion, each of said first parts adapted to be removably mounted on said second part such that an adjustment of said distance can be made by selecting a said second part and installing said first part on said second part.

11. A blast cabinet for cleaning surfaces of articles with an abrasive blast media comprising a housing defining a blast chamber with an interior;

a blast nozzle disposed in said blast chamber and connected to a source of an abrasive blast media for directing a flow of the blast media carried in a stream of air under pressure against the surface of an article to be cleaned located inside said blast chamber whereby spent blast media normally is dispersed throughout said blast chamber in a manner so as to obscure visual observation of a portion of the article being cleaned from outside said blast chamber;

window means for observing the article during cleaning including an elongated tubular member having an interior an inner end portion extending into the interior of said blast chamber and an outlet opening into said blast chamber which serves as an inner viewing port situated in the vicinity of but spaced from the article to be cleaned so there is a viewing zone between said inner viewing port and the article to be cleaned, said tubular member further having an outer end portion including a transparent window member closing the interior of said tubular member and cooperating therewith to define an outer viewing port through which an operator located outside said blase chamber can direct his or her line of sight through the interior of said tubular member to observe the article being cleaned through said inner viewing port;

air inlet means open to the atmosphere and connected in fluid communication with the interior of said tubular member at a location spaced inwardly from said window in a direction toward the interior of said blast chamber; and ventilation means for removing spent blast media from said blast chamber and for drawing ambient air through said inlet means and through said tubular member for discharge into said viewing zone at a velocity and volume sufficient to provide a purging action for purging away a sufficient amount of spent blast media dispersed in said viewing zone to facilitate observation of at least the portion of the article being cleaned through said outer viewing port.

12. A blast chamber according to claim 11 wherein said housing includes a front wall;

the outer end portion of said tubular member includes an extension extending outwardly beyond said front wall; and said air inlet means includes a generally vertical stack means connected in fluid communication with the interior of said extension.

13. A blast cabinet according to claim 12 including a silencer in said stack means for attenuating noise normally created by the flow of air through said stack means and said tubular member and generated inside said blast chamber by the blasting operation.

14. A blast cabinet according to claim 12 wherein said tubular member includes means for adjusting the distance between said inner viewing port and the article being cleaned.

15. A blast cabinet according to claim 14 wherein said adjustment means comprises said tubular member having a plurality of first parts including said inner end portion and said inner viewing port, each having a different length, and a second part including said outer end portion, each of said first parts adapted to be removably mounted on said second part such that an adjustment of said distance can be made by selecting a said second part and installing said first part on said second part.

16. Apparatus for cleaning the surfaces of articles with a cleaning media comprising a housing defining a cleaning chamber;

cleaning means in said chamber for directing a pressurized flow of the cleaning media against a surface of an article to be cleaned located inside said chamber whereby spent cleaning media normally is dispersed throughout said chamber in a manner so as to obscure visual observation of a portion of the article being cleaned from outside said chamber;

observation means for observing the article during cleaning from outside said chamber and having a viewing portion extending into said chamber in the vicinity of but spaced from the article to be cleaned such that there is a viewing zone between said viewing portion and the article to be cleaned; and gas delivery means for directing a flow of gas into said viewing zone to provide a purging action for purging away a sufficient amount of spent cleaning media dispersed in said viewing zone to facilitate observation via said observation means of at least that portion of the article being cleaned.

17. Apparatus according to claim 16 wherein said observation means comprises optical viewing means including an optical lens assembly disposed in said cleaning chamber adjacent said viewing zone and operably connected to a visual monitor remote from said cleaning chamber to produce a visual image of at least that portion of the article being cleaned on said visual monitor.

18. Apparatus according to claim 17 including a movable member extending into said cleaning chamber and carrying said lens assembly, said cleaning means and said gas delivery means in a fixed relationship for common movement with said movable member and movement relative to the article for cleaning.

19. Apparatus according to claim 17 including means supporting said lens assembly, said cleaning means and said gas delivery means in a fixed relationship inside said cleaning chamber; and a movable member extending into said cleaning chamber and carrying the article to be cleaned for movement of the article relative to the flow of cleaning media.

20. Apparatus according to claim 17 including a first movable member extending into said cleaning chamber and carrying said lens assembly, said cleaning means and said gas delivery means being mounted in a fixed relationship for common movement with said first moveable member and for movement relative to the article; and a second movable member extending into said cleaning chamber and carrying the article to be cleaned for movement of the article relative to the flow of cleaning media.

21. A blast cabinet for cleaning surfaces of articles with an abrasive blast media comprising a housing defining a blast chamber;

a blast nozzle disposed in said blast chamber and connected to a source of an abrasive blast media for directing a flow of the blast media carried in a stream of gas under pressure against a surface of an article to be cleaned located inside said blast chamber whereby spent blast media normally is dispersed throughout said blast chamber in a manner so as to obscure visual observation of a portion of the article being cleaned from outside said blast chamber;

an optical lens assembly for observing the article during cleaning and having a viewing portion situated in said chamber in the vicinity of but spaced from the article to be cleaned so there is a viewing zone between said viewing portion and the article to be cleaned, said lens assembly operably connected to a visual monitor remote from said blast chamber to produce a visual image of at least that portion of the article being cleaned on said visual monitor; and gas delivery means for directing a flow of gas into said viewing zone to provide a purging action for purging away a sufficient amount of spent blast media dispersed in said viewing zone to facilitate observation on said visual monitor of at least the portion of the article being cleaned.

22. A blast cabinet according to claim 21 wherein said gas delivery means includes conduit means having an inlet open to the atmosphere and an outlet located adjacent to said viewing zone and ventilation means for removing spent blast media from said blast chamber and for drawing air through said conduit means at a velocity and volume required to produce said purging action.

23. A blast cabinet according to claim 22 including a movable member extending into said blast chamber and carrying said lens assembly, said blast nozzle and said conduit means in a fixed relationship for common movement with said member and movement relative to the article for cleaning.

24. A blast cabinet according to claim 22 including means supporting said lens assembly, said cleaning means and said gas delivery means in a fixed relationship inside said cleaning chamber; and a movable member extending into said cleaning chamber and carrying the article to be cleaned for movement of the article relative to the flow of cleaning media.

25. A blast cabinet according to claim 22 including a first movable member extending into said blast chamber and carrying said lens assembly, said blast nozzle and said conduit means being mounted in a fixed relationship for common movement with said first movable member; and a second movable member extending into said cleaning chamber and carrying the article to be cleaned for movement of the article relative to the flow of blast media from said blast nozzle.

26. Apparatus for cleaning the surfaces of articles with a cleaning media comprising a housing defining a cleaning chamber;

a directing device disposed in said chamber to direct a pressurized flow of the cleaning media against a surface of an article located inside said chamber;

an observation device disposed to permit observation of the article during cleaning and having a viewing portion extending into said chamber such that there is a viewing zone between said viewing portion and the article;

a fluid inlet in said housing; and a fluid guiding device in fluid communication with said fluid inlet and disposed to guide a flow of gas into said viewing zone.

27. Apparatus according to claim 26 wherein said observation device comprises a tubular member extending from a first end at the outside of said housing to a second end within said housing; and a window covering the first end of said tubular member.

28. Apparatus according to claim 26 wherein said fluid guiding device guides fluid into said tubular member.

29. Apparatus according to claim 26 wherein said observation device comprises a lens assembly and said fluid guiding device includes an outlet and a hose, the hose being coupled between the fluid inlet and said outlet.

* * * * *